United States Patent [19]

Baker et al.

[11] Patent Number: 4,580,918

[45] Date of Patent: Apr. 8, 1986

[54] WRITING INSTRUMENT HAVING PLURAL NIBS WITH ONE BEING RETRACTABLE

[75] Inventors: Hugh William B. Baker, Beaconsfield; Ivor J. M. Fehr, Old Basing, both of England

[73] Assignee: The Gillette Company, Boston, Mass.

[21] Appl. No.: 475,432

[22] Filed: Mar. 15, 1983

[30] Foreign Application Priority Data

Mar. 22, 1982 [GB] United Kingdom ..... 8208329

[51] Int. Cl.[4] ..... B43K 8/02; B43K 24/06; B43K 27/00

[52] U.S. Cl. ..... 401/29; 401/19; 401/20; 401/22; 401/23; 401/28; 401/35; 401/109; 401/116; 401/198; 401/199

[58] Field of Search ..... 401/16, 17, 19, 20, 401/22, 28, 29, 34, 35, 195, 116, 109, 23

[56] References Cited

U.S. PATENT DOCUMENTS

| | | | |
|---|---|---|---|
| 1,534,629 | 4/1925 | Anshen | 401/17 |
| 1,738,367 | 12/1929 | Haught | 401/20 |
| 2,591,027 | 4/1952 | Turnes | 401/19 |
| 3,247,828 | 4/1966 | Basham | 401/230 |
| 3,684,389 | 8/1972 | Eron et al. | 401/198 |
| 3,687,562 | 8/1972 | Basham | 401/230 |
| 3,792,931 | 2/1974 | Ganz | 401/109 |

FOREIGN PATENT DOCUMENTS

| | | | |
|---|---|---|---|
| 2459860 | 6/1976 | Fed. Rep. of Germany | 401/34 |
| 2616439 | 10/1977 | Fed. Rep. of Germany | 401/34 |

*Primary Examiner*—Steven A. Bratlie

*Attorney, Agent, or Firm*—John P. Morley

[57] ABSTRACT

A writing instrument comprising a plurality of coaxial writing nibs and means for advancing and retracting the nibs relative to one another to adjust a selected nib into an operative writing position, whereby the instrument is adjustable to produce lines of different predetermined widths.

4 Claims, 3 Drawing Figures

WRITING INSTRUMENT HAVING PLURAL NIBS WITH ONE BEING RETRACTABLE

BACKGROUND OF THE INVENTION

1. Field of the Invention

This invention concerns writing instruments and in particular reservoir pens.

2. Description of the Prior Art

The majority of pens available on the market are designed to lay down an ink trace of substantially constant width. However, it is often required to draw lines of different controlled widths. In order to meet this need, there has been proposed a pen with a body to which may be attached any one of a series of writing heads fitted with nibs of different sizes. The need to replace the writing head each time the line width is to be changed is very inconvenient. It is also known to provide a pen with a broad nib so that lines of variable width can be produced by moving the pen across the paper with the nib at different angles to the direction of movement. In this case considerable skill and dexterity are required to produce lines of uniform width.

According to another prior proposal, an inner nib is located within a tubular outer nib and is biased forwardly by a spring. Under light writing pressure, the inner nib is operative, but by increasing the pressure, it can be retracted so that the tubular outer nib takes over. With a pen of this construction, much skill is also required to write continuously with an ink trace of the desired width.

SUMMARY OF THE INVENTION

In accordance with the present invention, there is provided a writing instrument comprising a plurality of coaxial writing tips and means for advancing and retracting the tips relative to one another to adjust a selected tip into an operative writing position, whereby the instrument is adjustable to produce lines of different predetermined widths.

In one particular form of pen embodying the invention, a fine inner nib is received slidably within an outer tubular nib, both nibs being of porous material, and the inner nib is coupled to an advancing/retraction mechanism located at the rear end of the pen barrel and operable to advance or retract the fine nib with respect to the outer nib.

BRIEF DESCRIPTION OF THE DRAWING

A pen of this construction will now be described in greater detail with reference to the accompanying drawings, in which.

DESCRIPTION OF THE PREFERRED EMBODIMENT

Figure 1:
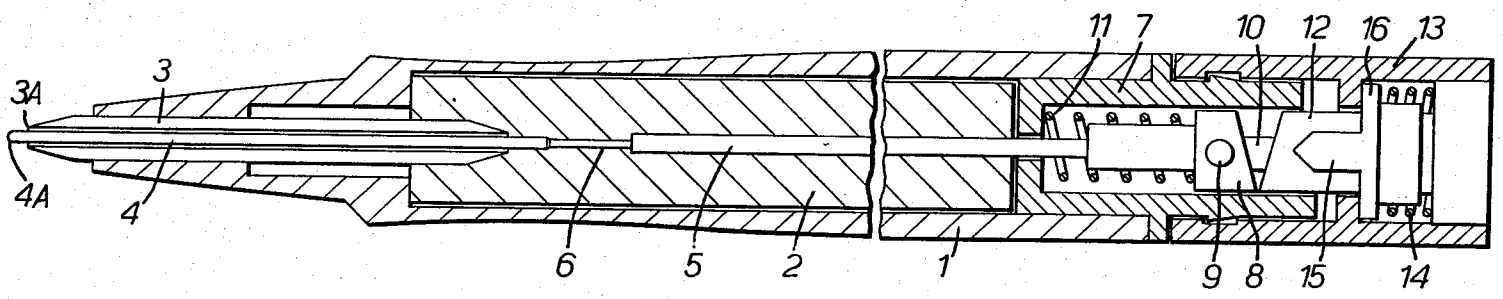
FIG. 1 is an axial cross-section through the pen which is shown set for drawing a fine line.
Figure 2:
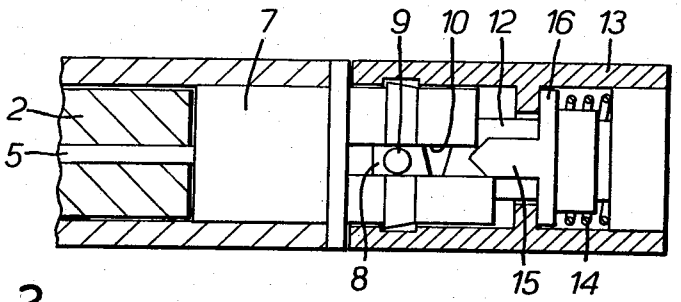
FIG. 2 is a detailed view showing the nib advancing-/retraction mechanism in side elevation.

The illustrated pen comprises a barrel 1 accomodating an ink reservoir provided by a mass of porous material 2. In the forward end of the barrel 1, a tubular outer nib 3 of porous material is fixed with its outer end projecting to define a writing tip 3A and its inner end extending into the reservoir 2. An inner nib 4 formed as a rod of porous material is slidable in the outer nib 3 and projects rearwardly beyond the inner end of the latter into the reservoir 2. Crimped to the inner end of nib 4 is an elongated tube 5, and between the tube 5 and nib 3, the nib 4 has a reduced portion 6 to facilitate flow of ink into the capillary channels of the nib from the reservoir. Conveniently the inner nib 4 may be made from an acetyl copolymer extrusion, and the outer nib 3 may be made from bonded polyamide fibers.

The rear end of tube 5 is connected to a mechanism operable to advance and retract the writing tip 4A of the inner nib 4 relative to that of the outer nib 3. The mechanism includes a cup-shaped body 7 fixed to the end of barrel 1 and having a hole in its end wall through which the tube 5 passes. A cam follower 8 is attached to the tube and is guided for longitudinal movement in the body by a pair of lugs 9 which engage in opposed longitudinal slots 10 in the body 7. The rear face of cam follower 8 is inclined to the axis and under the bias of a spring 11 abuts a similarly inclined face on a cam 12. The cam 12 is fast with a cap 13 journalled on the body 7, and carries slidably a collar 16. The action of a spring 14 urges the collar 16 towards a shoulder formed on the inside of the cap. A tooth 15 on collar 16 has a V-shaped forward end for engaging in the open ends of the slots 10, thereby forming with the body 7 a resilient detent device for locking the cam 12 and cap 13 releasably in either of two rotational positions. It should be noted that the body 7 is extended over one-half of its periphery between the slots 10 to define lateral stops against which the tooth 15 abuts to limit the rotation of cap 13 to 180° relative to the barrel 1.

Figure 3:
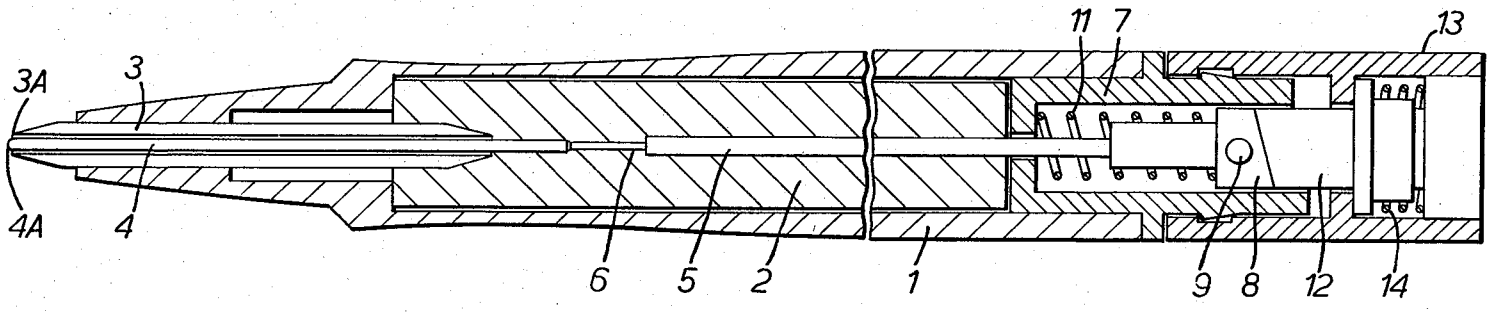
FIG. 3 is a view similar to FIG. 1, but showing the pen set for drawing a broad line.

With the cap 13 in the rotational position shown in FIG. 1, the cam follower 8 is pushed forwardly by cam 12 and the writing tip 4A of the inner nib 4 projects substantially beyond that of nib 3 so that under all normal writing conditions the tip 3A is clear of the paper and the pen will lay down a fine ink trace by means of the tip 4A. Turning the cap through 180° will firstly disengage the tooth 15 from slot 10, pushing collar 16 back against spring 14, and then rotate the cam 12 until the tooth 15 engages in the other slot 10. During this rotation of the cam 12, the cam follower 8 is pushed back by the spring 11 until the FIG. 3 position is reached and the tip 4A of nib 4 is retracted into substantial alignment with the tip 3A of nib 3. The pen is now adjusted to draw a broader line by means of the outer nib 3. In this condition the tip 3A is supported by the inner nib 4. Reverse rotation of the cap 12 will reset the nib 4 to the FIG. 1 position. Thus, the pen is easily and conveniently adjusted for produceing lines of two different predetermined widths.

The pen design may be easily modified without departing from the principles of the invention. Any suitable nib advancing/retraction mechanism may be employed and that described above is given as a non-limiting example only. Furthermore, more than two coaxial nibs may be incorporated in the pen and be adjustable for producing a corresponding number of different line widths. In this case the advancing/retraction mechanism may be adapted to adjust the nibs for obtaining a progressively increasing and decreasing operative nib size.

Having thus described our invention, what we claim as new and desire to secure by Letters Patent of the United States is:

1. A pen comprising a body supporting a fixed tubular outer nib which is coaxial with and surrounds an inner rod-shaped nib slidably arranged within the fixed outer nib and adjustable means operationally communicating with the inner nib to axially move only the inner nib with respect to the fixed outer nib to first and second operative positions and to releasably lock the inner nib in the first and second operative positions so that when moved to and locked in the first operative position, the inner nib is extended with respect to the fixed outer nib and can independently produce a written line of a first desired width and when moved to and locked in the second operative position, the inner nib is retracted into alignment with respect to the fixed outer nib so that the inner and outer nibs can produce a written line of a second desired width wider than the first desired width, both nibs being made of a porous material having capillary channels and being in fluid communication with an ink reservoir.

2. A pen according to claim 1 wherein said body has opposed forward and rearward ends, and wherein said adjustable means comprises a mechanism mounted adjacent the rear end of said body and coupled to said inner nib.

3. A pen according to claim 2 wherein the mechanism comprises a cam follower connected to said inner nib and which is guided for longitudinal movement with respect to the body, and a cam rotatable relative to the body to displace the cam follower.

4. A pen according to claim 1 wherein said adjustable means includes a resilient detent device for locking said inner nib releasably in said first and second positions.

* * * * *